US006804977B1

(12) United States Patent
Grabelle

(10) Patent No.: US 6,804,977 B1
(45) Date of Patent: Oct. 19, 2004

(54) NECKLACE AND BRACELET PENDANT-CLASP

(76) Inventor: David Grabelle, 11708 Lone Tree Ct., Columbia, MD (US) 21044

( * ) Notice: Subject to any disclaimer, the term of this patent is extended or adjusted under 35 U.S.C. 154(b) by 0 days.

(21) Appl. No.: 10/359,387

(22) Filed: Feb. 6, 2003

Related U.S. Application Data

(60) Provisional application No. 60/392,478, filed on Jun. 28, 2002.

(51) Int. Cl.[7] ..... A44C 5/00

(52) U.S. Cl. ..... 63/3.1; 63/3; 24/265 EC; 24/265 R

(58) Field of Search ..... 24/265 EC, 265 R, 24/459–462, 614–616, 574.1, 629, 631, 633, 640, 642, 652, 656, 662, 669, 700, 702, 596.1; 63/1.11–1.14, 1.16–1.18, 3, 3.1, 18–20

(56) References Cited

U.S. PATENT DOCUMENTS

| | | | | | |
|---|---|---|---|---|---|
| 147,078 | A | * | 2/1874 | Stone | 24/574.1 |
| 2,233,071 | A | * | 2/1941 | Bangs | 24/662 |
| 2,725,610 | A | * | 12/1955 | Smith | 24/656 |
| 3,135,031 | A | | 6/1964 | Brosse | |
| 4,001,923 | A | | 1/1977 | Frankel et al. | |
| 4,170,809 | A | * | 10/1979 | Geldwerth et al. | 24/574.1 |
| 4,426,854 | A | * | 1/1984 | Geldwerth et al. | 24/616 |
| 4,527,316 | A | | 7/1985 | Murphy | |
| 4,745,667 | A | * | 5/1988 | Conte | 24/615 |
| 5,214,940 | A | | 6/1993 | Capifali | |
| 6,112,373 | A | | 9/2000 | Steinhauer et al. | |
| 6,230,961 | B1 | | 5/2001 | Graser | |
| 6,233,793 | B1 | * | 5/2001 | Wanzenbock | 24/615 |
| 6,293,129 | B1 | | 9/2001 | Gurevich | |

FOREIGN PATENT DOCUMENTS

| | | | |
|---|---|---|---|
| GB | 2 272 938 | * | 6/1994 |

* cited by examiner

*Primary Examiner*—Robert J. Sandy
*Assistant Examiner*—Ruth C. Rodriguez
(74) *Attorney, Agent, or Firm*—William S. Ramsey

(57) ABSTRACT

The combination pendant clasp of this disclosure is suitable for a necklace or bracelet. It provides a positive locking clasp which is manipulated in front of the wearer. The pendant clasp has two principle members, both of which may be decorated with precious stones, and may symbolize a relationship between individuals. Placement of the clasp in the front of a necklace or bracelet avoids the chance that the clasp will become inadvertently and unnoticed open and the jewelry lost.

20 Claims, 7 Drawing Sheets

NECKLACE AND BRACELET PENDANT-CLASP

CROSS-REFERENCE TO RELATED APPLICATIONS

This application claims priority from provisional application Ser. No. 60/392,478, filed Jun. 28, 2002.

A portion of the disclosure of this patent document contains material which is subject to copyright protection. The owner has no objection to the facsimile reproduction by anyone of the patent document or patent disclosure, as it appears in the Patent and Trademark Office patent files or records, but otherwise reserves all copyright rights whatever.

STATEMENT REGARDING FEDERALLY SPONSORED RESEARCH OR DEVELOPMENT

Not Applicable.

Reference to a "Microfiche appendix."

Not Applicable.

BACKGROUND OF THE INVENTION

1. Field of the Invention

This invention relates to the field of jewelry having a combination pendant and clasp.

2. Description of Related Art Including Information Disclosed Under 37 CFR 1.97 and 37 CFR 1.98

This patent application discloses a combination decorative pendant and clasp for a necklace, bracelet, wristwatch band, or the like, with a concealed latch which avoids the necessity for a separate clasp at the back of the necklace wearer's neck or wrist.

U.S. Pat. No. 3,135,031 discloses a necklace clasp with a tubular element into which a rectangular section engages. A protruding portion on the lateral face of the tubular element locks a hook which prevents opening of the clasp. A bar locks the hook in place.

U.S. Pat. No. 4,001,923 discloses a jewelry clasp comprising a female member and a complementary male member with a releasable locking member disposed within the body of the female member. The locking member is of integral one piece construction.

U.S. Pat. No. 4,527,316 discloses a jewelry chain-stay with a fastener with a U-shaped female member and a folded male member. The male member is retained by friction in the closed fastener.

U.S. Pat. No. 5,214,940 discloses a dress cap for locks which is a clamshell covering for a chain lock.

U.S. Pat. No. 6,112,373 discloses a clasp assembly with provisions for easily attaching and detaching "strands" defined as single or plural wire cables, chains or other like flexible elements for the purpose of adding or removing "slides", interchangeable jewelry pieces. The clasp assembly includes a housing with an opening and an inner chamber into which a resilient tongue is inserted.

U.S. Pat. No. 6,230,961 discloses an improved method for attaching a clasp link to a chain.

U.S. Pat. No. 6,293,129 discloses a multi-stone setting for gemstones or diamonds with a frame member and crossbars. This is an invisible mounting for 9 or 12 gemstones which gives a larger appearance than a single gemstone of similar carat weight.

None of the prior art discloses the features of the present invention, that of a decorative combination pendant-clasp with a pocket which receives a mating portion, provisions for locking the mating portion in place, and provisions for display of the decorative elements of the mating portion in a decorative frame.

BRIEF SUMMARY OF THE INVENTION

This application discloses a combination pendant-clasp with a female member having a top and a bottom, a front and a rear side, a left and a right end, and a pocket between the front and rear side with an opening at the top of the female member between the front and rear sides. The front side of the female member has an opening. The pendant-clasp further has a male member of approximately rectangular cross-section having a top and a bottom, a flat front side, a flat rear side, a left end and a right end. The male member is adopted for insertion into the pocket of the female member with the front side of the male member visible through the opening in the front side of the female member. A pin is located at the top of the male member, the pin extending approximately perpendicular to a side of the male member. A lock at the top of the female member is used for securing the pin to the female member. An attachment site for attachment of a strand is located at one side of the female member, and a similar attachment site for attachment of a strand is located at one side of the male member.

An objective of this patent is to provide a pendant-clasp which combines the decorative aspects of a pendant with the functional aspects of a clasp.

Another objective is to provide a pendant-clasp which may be used to secure the ends of a necklace, bracelet, wristwatch band, or other similar type of jewelry.

Another objective is to provide a pendant-clasp which may symbolize the romantic union of individuals.

Another objective is to provide a pendant-clasp which may be constructed of precious metals and precious stones.

Another objective is to provide a pendant-clasp which may be constructed of inexpensive materials and non-precious stones.

Another objective is to provide a pendant-clasp which avoids an unsightly clasp at the back of the necklace, bracelet, wristwatch band or the like.

Another objective is to provide a pendant-clasp which can be opened or closed in the front of the wearer without rotating the necklace, bracelet, or wristwatch band about the wearer's neck or wrist.

A final objective is to provide a pendant-clasp which may be manufactured of inexpensive or expensive materials without adverse effect on the environment.

DETAILED DESCRIPTION OF THE INVENTION

In this disclosure flexible single or plural chains, wire cables, bands, or other similar ligatures used to retain necklaces, bracelets and watchbands in place are termed "strands".

Figure 1:
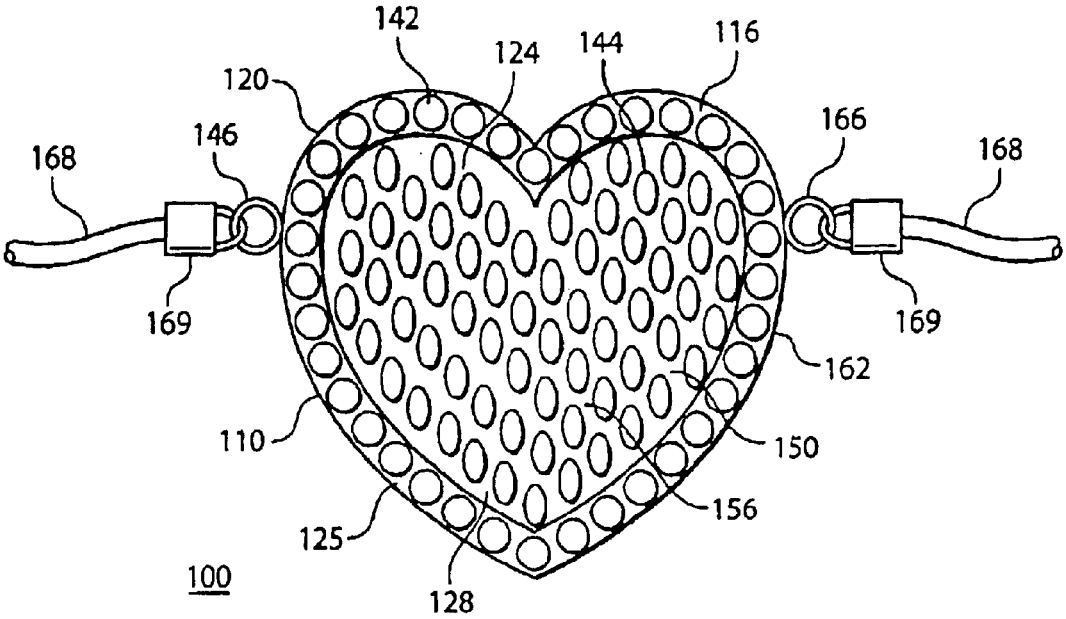
FIG. 1 is a plan view of the first embodiment pendant-clasp.

FIG. 1 is a plan view of the heart shaped first embodiment pendant-clasp 100. The pendant-clasp comprises a heart shaped male member 150 which is inserted into and retained by a heart shaped female member 110. A plurality of decorative elements, preferably diamonds 142 are arrayed about the periphery 125 of the front side 116 of the female member 110. The front side 156 of the male member 150 is visible through an opening 124 in the front side 116 of the female member 110. A multiplicity of decorative elements, preferably sapphires 144 are set into the front side 156 of the male member 150. A circular attachment site 146 is attached to the left end 120 of the female member 110. A circular attachment site 166 is attached to the right end 162 of the male member 150. A strand attachment side 169 attaches each end of a strand 168 to one of the circular strand attachment sides, 146 and 166. The circular strand attachment sites are rings which are firmly attached to the members of the pendant-clasp.

Figure 2:
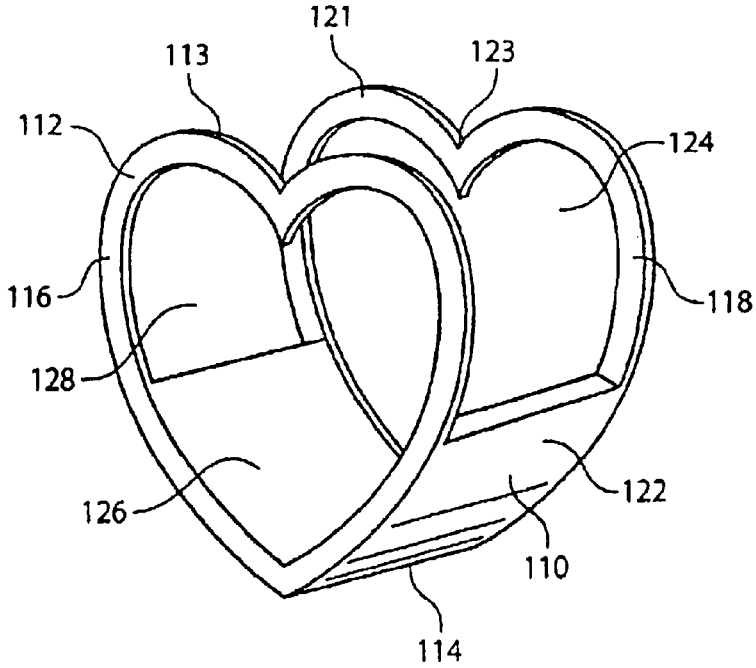
FIG. 2 is a perspective view of the female member of the first embodiment pendant-clasp.

FIG. 2 is a perspective view of the female member 110. The front loop 112 is shown along with the middle of the front loop 113. The opening 128 in the front side 116 of the female member 110 is shown, along with the opening 124 in the rear side 118. The rear loop 121 is shown along with the middle of the rear loop 123. The bottom 114, and right end 122, which, along with the left end 120 (not shown in FIG. 2), connect the front side 116 and the rear side 118 with the formation of a pocket 126 between the front side 116 and rear side 118. The purpose of the opening 128 in the front side 116 is to make visible the front side of the male member when the clasp is closed. The purpose of the opening 124 in the rear side 118 is to reduce the amount of material required in the manufacture of the pendant-clasp and to make visible the rear side of the male member, which may have engraving or other dicta on its surface.

Figure 3:
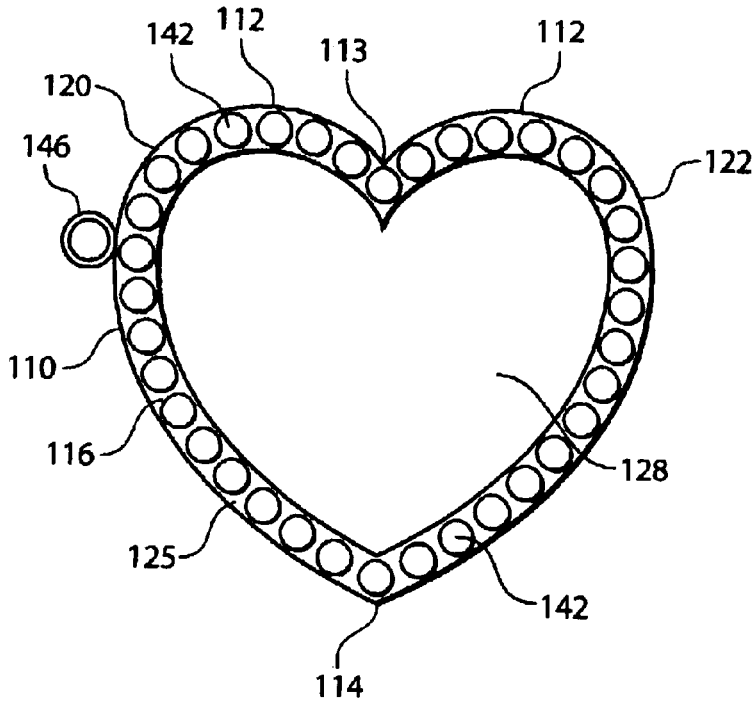
FIG. 3 is a front view of the female member of the first embodiment pendant-clasp.

FIG. 3 is a view of the front side 116 of the female member 110. Visible in FIG. 3 are the front upper loop 112, the middle of the front upper loop 113, the left end 120, the right end 122, the bottom 114, the female member circular strand attachment site 146, the decorative elements, preferably diamonds 142 arrayed about the periphery 125 of the front side 116, and the opening in the front side 128.

Figure 4:
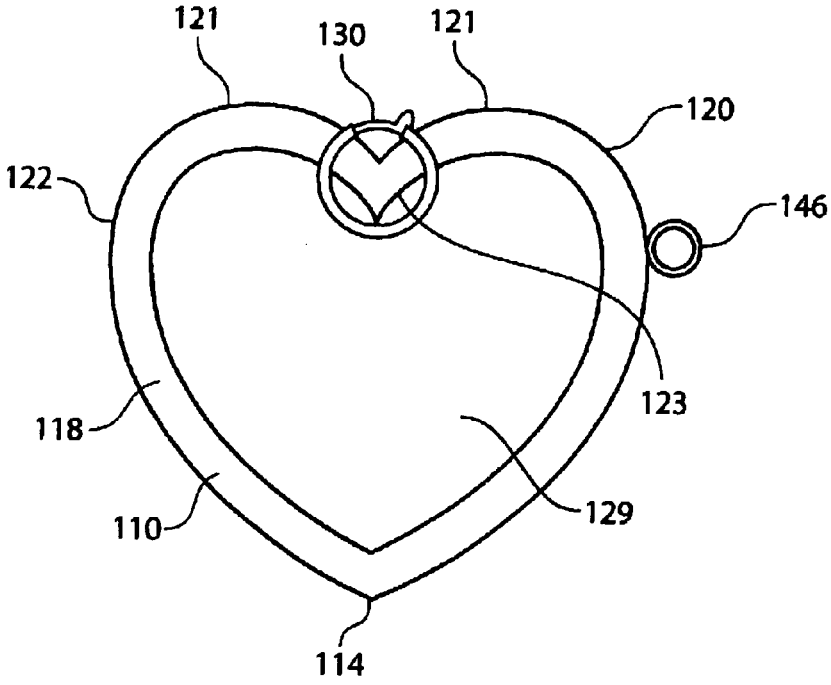
FIG. 4 is a rear view of the female member of the first embodiment pendant-clasp.

FIG. 4 is a view of the rear side 118 of the female member 110. Visible in FIG. 4 are the rear upper loop 121, the middle of the rear upper loop 123, the left end 120, the right end 122, the bottom 114, the female member circular strand attachment site 146, the lock 130, and the opening in the rear side 129.

Figure 5:
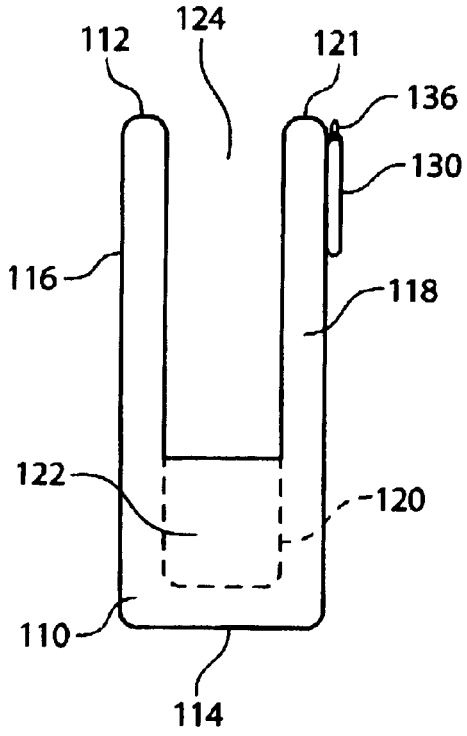
FIG. 5 is a side view of the female member of the first embodiment pendant-clasp.

FIG. 5 is a side view of the female member 110. Visible in FIG. 4 are the front upper loop 112, the rear upper loop 121, the bottom 114, the front side 116, the rear side 118, and the right end 122 which, along with the bottom 114 and the left end 120 (not visible in FIG. 5) connect the front side 116 and the rear side 118. A pocket 126 formed between the front side 116, rear side 118, and bottom 114 is depicted by dotted lines. The lock 130 and lock lever 136 located on the rear side 118 at middle of the rear loop 123 (not visible in FIG. 5) are also shown.

Figure 6:
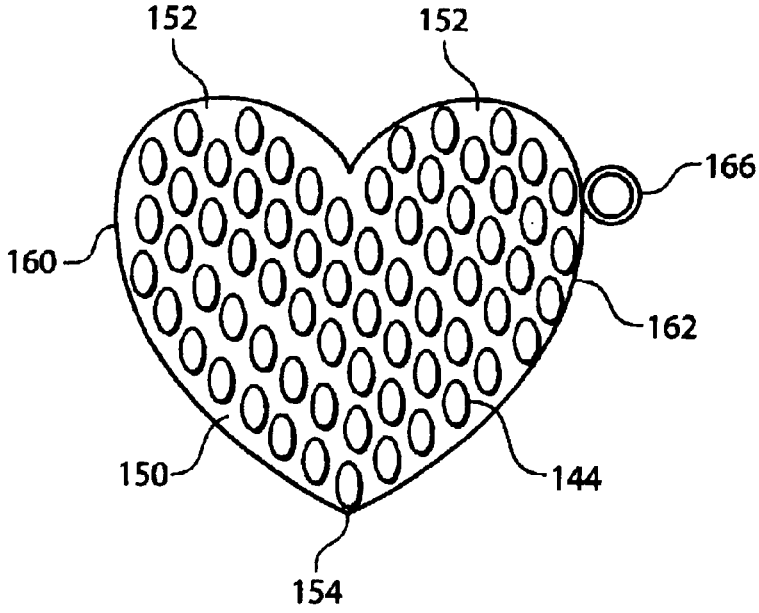
FIG. 6 is a front view of the male member of the first embodiment pendant-clasp.

FIG. 6 is a view of the front side 156 of the male member 150. Visible in FIG. 5 are the top 152, the bottom 154, the left end 160 and the right end 162. The male member circular stand attachment site 166 is attached to the right end 162. A multiplicity of decorative elements, preferably sapphires 144 are arrayed over the front side 156. The front side 156 is outwardly visible when the clasp is closed.

Figure 7:
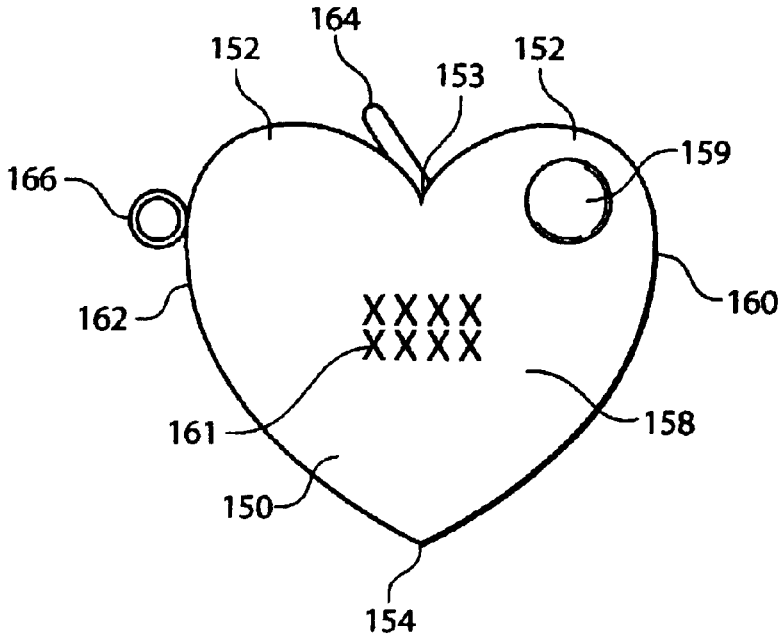
FIG. 7 is a rear view of the male member of the first embodiment pendant-clasp.

FIG. 7 is a view of the rear side 158 of the male member 150. Visible in FIG. 7 are the top 152, the middle of the top 153, the pin 164, the right end 162, the left end 160, and the bottom 154. The male member circular strand attachment site 166 is attached to the right end 162. A slightly raised circular bearing 159 on the rear side 158 provides for a firm fit of the male member 150 in the female member 110 when the pendant-clasp is closed. The rear side 158 provides a surface for dicta 161 which may be engraved. While the rear side 158 is not outwardly visible when the clasp is closed, dicta 161 on the rear side may be viewed by the wearer through the opening 129 in the rear side 118 (visible in FIG. 4) and may be of a personal nature.

Figure 8:
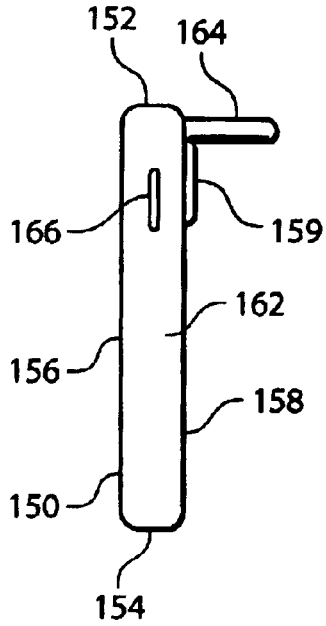
FIG. 8 is a side view of the male member of the first embodiment pendant-clasp.

FIG. 8 is a view of the right end 162 of the male member 150. Visible in FIG. 8 are the top 152, the bottom 154, the front side 156 and the rear side 158, the male member circular strand attachment site 166, the pin 164, which extends approximately perpendicular from the rear side 158, and the bearing 159.

Figure 9:
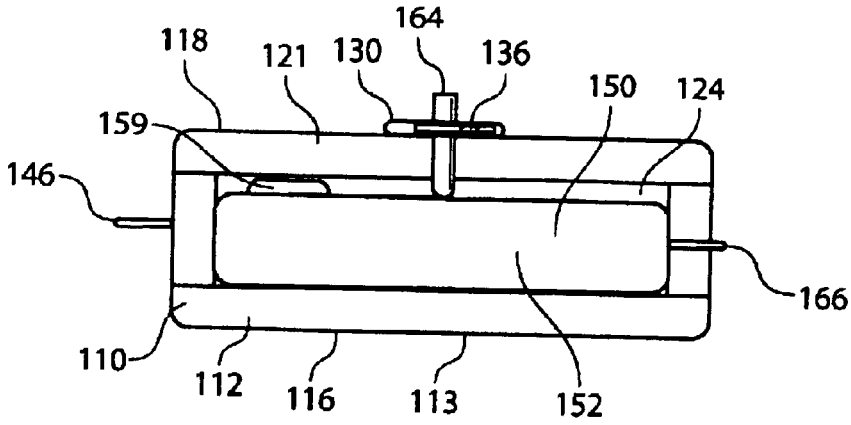
FIG. 9 is a top view of the first embodiment pendant-clasp.

FIG. 9 is a top view of the closed pendant-clasp. FIG. 9 shows the male member 150 inserted into the opening 124 at the top of the female member 110. Elements of the female member 110 visible in FIG. 9 include the top of the front loop 112, the middle of the front loop 113, the front side 116 the circular strand attachment site 146, the rear side 118, and the rear loop 121. Attached to the rear side 118 of the female member 110 is the clasp link lock 130 and the lock lever 136. Elements of the male member 150 visible in FIG. 9 include the top 152, the bearing 159, and the pin 164.

Figure 10:
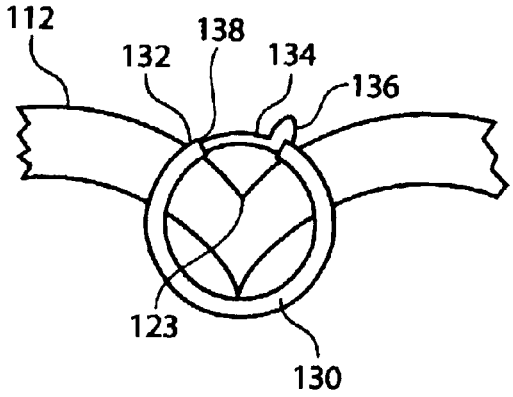
FIG. 10 is a detailed view of the clasp link lock mounted on the back of the female member of the first embodiment pendant-clasp.

FIG. 10 is a detailed view of the clasp link lock 130 located at the middle 123 of the rear loop 112. Visible in FIG. 10 is the clasp link 132, the clasp 134, and the lever 136. The movement of the lever 136 causes rotation of the clasp 134 against a spring biasing the clasp into the closed position. Movement of the clasp 134 out of the opening 138 in the clasp link allows insertion of the pin (164 in FIG. 9).

Release of the lever 136 allows the clasp to close, retaining the pin in the clasp link lock and the male member attached to the female member.

Figure 11:
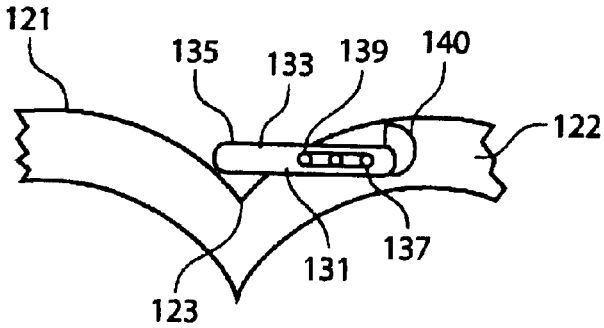
FIG. 11 is a detailed view of the slide lock mounted on the back of the female member of the first embodiment pendant-clasp.

FIG. 11 is a second embodiment lock 131. This second embodiment lock slides from an unlocked position to a locked position. The body 133 has a oval slot 137. The lock 131 is attached to the rear loop 121 of the female member 150 by two pins 139. The lock slides from a closed to an open position when manipulated by the handle 140. In the closed position the end 135 covers the top of the v-shaped middle 123 of the rear loop 121, and retains the pin (164 in FIG. 9) of the male member 110 which is inserted therein. In the open position the lock is slid toward the right end 122 of the female member 150 thereby freeing the pin and allowing the male member to be removed from interaction with the female member and the pendant clasp to be open and the associated necklace, bracelet or watch to be removed.

In use, the necklace, bracelet, or wristwatch band is looped about the wearer's neck or wrist and the male member of the pendant-clasp inserted into the opening at the top of the female member with the front side of the male member toward the front side of the female member, so that the decorative front side of the male member is visible through the opening in the front side of the female member. The lock on the female member is opened using the lever, the pin on the male member is inserted into the lock, and the lever is released, allowing the lock to close and retaining the male member in conjunction with the female member. In this way the necklace, bracelet, or wristwatch band encircles the wearer's neck or wrist To remove the necklace, bracelet, or wristwatch band, the lever is moved to release the pin from the lock and the male member is separated from the female member.

The heart shape of the first embodiment may symbolize the romantic relationship between individuals. Other shapes may have other symbolic significances.

Figure 12:
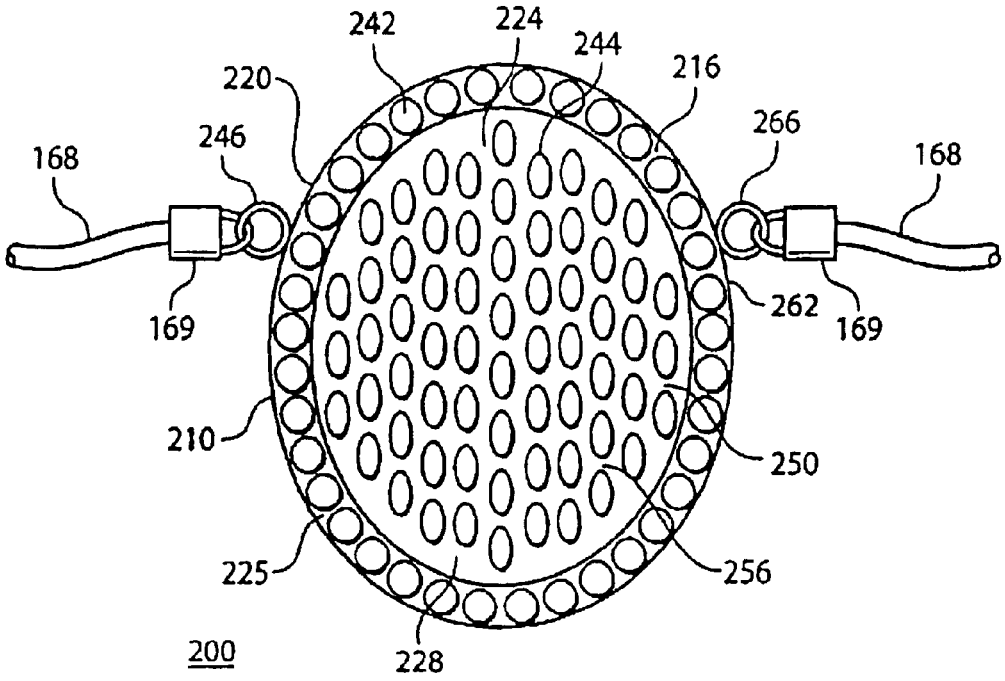
FIG. 12 is a plan view of the second embodiment pendant-clasp.

FIG. 12 is a plan view of the oval shaped second embodiment pendant-clasp 200. The second embodiment pendant-clasp differs from the first embodiment in that the second embodiment is oval shaped rather than heart shaped. The second embodiment pendant-clasp comprises an oval shaped male member 250 which is inserted into and retained by an oval shaped female member 210. A plurality of decorative elements, preferably diamonds 242 are arrayed about the periphery 225 of the front side 216 of the female member 210. The front side 256 of the male member 250 is visible through an opening 228 in the front side 216 of the female member 210. A multiplicity of decorative elements, preferably sapphires 244 are set into the front side 256 of the male member 250. A circular attachment site 246 is attached to the left end 220 of the female member 210. A circular attachment site 266 is attached to the right end 262 of the male member 250. A strand attachment side 169 attaches each end of a strand 168 to one of the circular attachment sides, 246 and 266.

Figure 13:
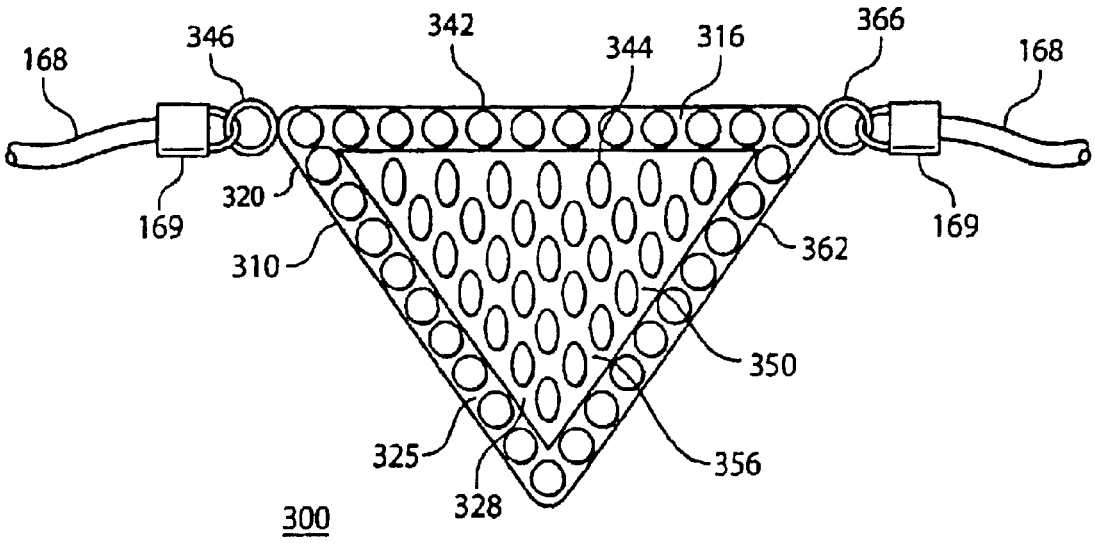
FIG. 13 is a plan view of the third embodiment pendant-clasp.

FIG. 13 is a plan view of the triangle shaped third embodiment pendant-clasp 300. The third embodiment pendant-clasp differs from thie first embodiment in that the third embodiment is triangle shaped rather than heart shaped. The third embodiment pendant-clasp comprises a triangle shaped male member 350 which is inserted into and retained by a triangle shaped female member 310. A plurality of decorative elements, preferably diamonds 342 are arrayed about the periphery 325 of the front side 316 of the female member 310. The front side 356 of the male member 350 is visible through an opening 328 in the front side 316 of the female member 310. A multiplicity of decorative elements, preferably sapphires 344 are set into the front side 356 of the male member 350. A circular attachment site 346 is attached to the left end 320 of the female member 310. A circular attachment site 366 is attached to the right end 362 of the male member 350. A strand attachment side 169 attaches each end of a strand 168 to one of the circular attachment sides, 346 and 366.

Other embodiments, such as a rectangular shaped pendant-clasp, and a circular shaped pendant-clasp, are contemplated but not illustrated.

Figure 14:
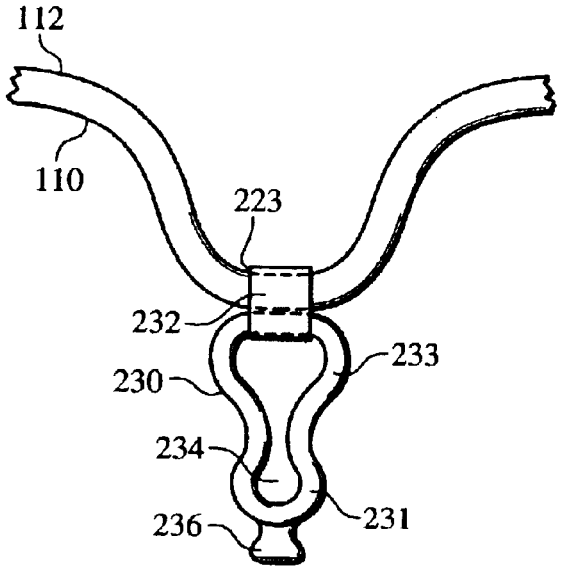
FIG. 14 is a detailed view of the third embodiment lock mounted on the back of the female member of the first embodiment pendant-clasp in the open position.

FIG. 14 is a detailed view of the third embodiment lock 230 mounted on the back 112 of the female member 110 of the first embodiment pendant-clasp in the open position. The third embodiment lock 230, termed a "figure-8" lock, is constructed of hard, resilient wire-like material in a figure-8 shape with an upper loop 231 which encloses an opening 234 and a lower loop 233. The lock is movably attached to the back 112 of the female member by a link 232. A knob 236 is attached to the outside of the upper loop 231.

Figure 15:
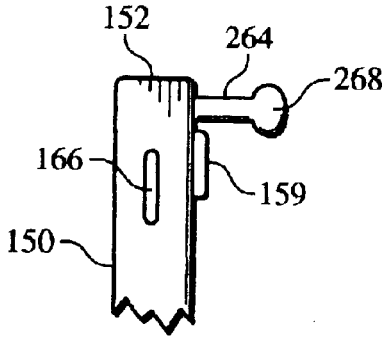
FIG. 15 is a side view of the male member of the first embodiment pendant-clasp showing the second embodiment pin.

FIG. 15 is a side view of the male member of the first embodiment pendant-clasp showing the second embodiment pin 264. The second embodiment pin is identical to the first embodiment pin 164 depicted in FIGS. 7, 8, and 9 with the addition of a knob 268 on the end of the second embodiment pin 264.

Figure 16:
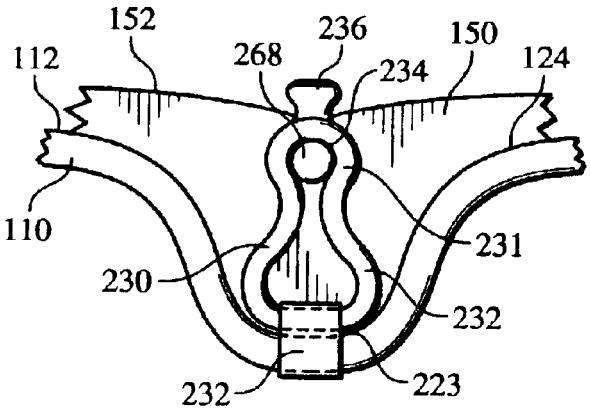
FIG. 16 is a detailed view of the closed pendant-clasp showing the third embodiment lock mounted on the back of the female member of the first embodiment pendant-clasp in the closed position.

FIG. 16 is a detailed view of the closed pendant-clasp showing the third embodiment lock 230 mounted on the back of the female member 112 of the first embodiment pendant-clasp in the closed position. The third embodiment lock 230 is used with the second embodiment pin (264 in FIG. 15). In use, pendant-clasp is closed by insertion of the male member 150 into the opening 124 at the top of the female member 110. The lock knob 236 is grasped with the fingers and the lock 230 swung upward so the pin knob 268 enters the opening 234 of the upper loop 231 thereby locking the lock. The lock is retained in the closed position by a friction fit between the pin knob 268 and the upper loop 231. The upper loop 231 and the lower loop 232 flex slightly to accommodate the diameter of the pin knob 268 when the lock is closed The procedure is reversed to unlock the lock, allowing separation of the male and female members of the pendant-clasp.

Any embodiment lock may be used with any embodiment pendant-clasp.

The pendant-clasp may be manufactures from any suitable hard, dense, malleable or moldable material, which may be polished to an attractive finish, and in which decorative stones may be mounted, preferable a precious metal. Suitable examples include nickel, gold, silver, platinum, and alloys thereof. Gold is preferred because of its relative hardness and resistance to scratching and corrosion. A preferred material is white gold, an alloy of gold and nickel. Other preferred materials are rose gold, a pink alloy of gold and copper; and other colored gold alloys, such as green or blue alloys. Two different colored gold alloys, or even three different colored gold alloys may be used.

The preferred decorative element on the pendant clasp is precious stones. The preferred precious stone decoration around the periphery of the front of the female member is diamonds. The preferred precious stone decoration array covering the front of the male member is sapphires. A preferred array of sapphires is multiple straight lines of sapphires Other precious stones may be used, such as rubies, pink sapphires, emeralds, and diamonds.

Other decorative elements may be used, such as engraving, enameling, and filigree may be used.

In a costume jewelry embodiment, the pendant clasp is constructed of materials other than precious metals, preferably of ceramics. Other suitable materials include copper, stainless steel, and hard plastics. Precious stones are not used in the costume jewelry embodiment. Preferred decorations include rhinestones. Other costume decorations include engraving, enameling, and filigree.

It will be apparent to those skilled in the art that the examples and embodiments described herein are by way of illustration and not of limitation, and that other examples may be used without departing from the spirit and scope of the present invention, as set forth in the appended claims.

I claim:

1. A pendant-clasp comprising:

a female member having a top and a bottom, a front and a rear side, a left and a right end, and a pocket between the front and rear sides with an opening at the top of the female member between the front and rear sides, the front side having an opening, a male member of approximately rectangular cross-section having a top and a bottom, a flat front side, a flat rear side, a left end and a right end, the male member adapted for insertion into the pocket of the female member, the front side of the male member visible through the opening in the front side of the female member, a pin at the top of the male member, the pin extending approximately perpendicular to a side of the male member, a lock at the top of the female member for securing the pin to the female member, an attachment site for attachment of a strand to one side of the female member, and an attachment site for attachment of a strand to one side of the male member.

2. The pendant-clasp of claim 1 further comprising a knob on the end of the pin.

3. The pendant-clasp of claim 1 wherein the attachment site on the female member is on the left end of the female member and the attachment site on the male member is on the right end of the male member.

4. The pendant-clasp of claim 1 wherein the attachment site on the female member is on the right end of the female member and the attachment site on the male member is on the left end of the male member.

5. The pendant-clasp of claim 1 wherein the lock is a clasp link lock.

6. The pendant-clasp of claim 1 wherein the lock is a slide lock.

7. The pendant-clasp of claim 1 wherein the lock is a figure-8 lock.

8. The pendant-clasp of claim 1 wherein the female member and the male member are heart shaped.

9. The pendant-clasp of claim 1 wherein the female member and the male member are oval shaped.

10. The pendant-clasp of claim 1 wherein the female member and the male member are triangle shaped.

11. The pendant-clasp of claim 1 wherein decorative elements are set around the periphery on the front side of the female member.

12. The pendant-clasp of claim 11 wherein the decorative elements are precious stones.

13. The pendant-clasp of claim 12 wherein the precious stones are diamonds.

14. The pendant-clasp of claim 1 wherein decorative elements are set on the front side of the male member.

15. The pendant-clasp of claim 14 wherein the decorative elements are precious stones.

16. The pendant-clasp of claim 15 wherein the precious stones are emeralds.

17. The pendant-clasp of claim 1 therein the material of construction is stainless steel, copper, brass, gold, silver, platinum, or white gold.

18. The pendant-clasp of claim 1 wherein the material of construction is white gold.

19. The pendant-clasp of claim 1 further comprising a bearing on the rear side of the male member.

20. A pendant-clasp comprising:

a female member having a top and a bottom, a front and a rear side, a left and a right end, and a pocket between the front and rear side with an opening at the top of the female member between the front and rear sides, the female member having a heart-shape, the front side of the female member having a heart-shaped opening, the female member having an array of diamonds surrounding the heart-shaped opening, a male member of approximately rectangular cross-section having a top and a bottom, a flat front side, a flat rear side, a left end and a right end, the male member having a heart-shape, the front side of the male member having an array of emeralds, the male member adapted for insertion into the pocket of the female member, the front side of the male member visible through the opening in the front side of the female member, a pin at the top of the male member, the pin extending approximately perpendicular to a side of the male member, the pin having a knob on the end distal from the side of the male member, a figure-8 lock at the top of the female member for securing the pin to the female member, an attachment site for attachment of a strand to one side of the female member, and an attachment site for attachment of a strand to one side of the male member.

* * * * *